US006313390B1

(12) United States Patent
Adriaans et al.

(10) Patent No.: US 6,313,390 B1
(45) Date of Patent: Nov. 6, 2001

(54) METHOD FOR AUTOMATICALLY CONTROLLING ELECTRONIC MUSICAL DEVICES BY MEANS OF REAL-TIME CONSTRUCTION AND SEARCH OF A MULTI-LEVEL DATA STRUCTURE

(75) Inventors: Pieter Willem Adriaans, AE Amersfoort; Maarten Van Den Dungen, DN Utecht, both of (NL)

(73) Assignee: Adriaans Adza Beheer B.V., Amersfoort (NL)

( * ) Notice: Subject to any disclaimer, the term of this patent is extended or adjusted under 35 U.S.C. 154(b) by 0 days.

(21) Appl. No.: 09/646,145

(22) PCT Filed: Mar. 12, 1999

(86) PCT No.: PCT/NL99/00138

§ 371 Date: Sep. 13, 2000

§ 102(e) Date: Sep. 13, 2000

(87) PCT Pub. No.: WO99/46758

PCT Pub. Date: Sep. 16, 1999

(30) Foreign Application Priority Data

Mar. 13, 1998 (NL) ..... 1008586

(51) Int. Cl.[7] ..... G10H 7/00

(52) U.S. Cl. ..... 84/645; 84/602; 84/609; 84/649

(58) Field of Search ..... 84/600–603, 607–610, 84/617, 622–625, 645, 649–650, 655, 659–660

(56) References Cited

U.S. PATENT DOCUMENTS

| | | | | |
|---|---|---|---|---|
| 4,982,643 | | 1/1991 | Minamitaka | 84/613 |
| 5,119,711 | * | 6/1992 | Bell et al. | 84/622 |
| 5,375,501 | | 12/1994 | Okuda | 84/611 |
| 5,418,323 | | 5/1995 | Kohonen | 84/609 |
| 5,451,709 | | 9/1995 | Minamitaka | 84/609 |
| 5,689,616 | | 11/1997 | Li | 395/2.41 |
| 5,869,782 | * | 2/1999 | Shishido et al. | 84/609 |
| 6,075,193 | * | 6/2000 | Aoki et al. | 84/609 |

FOREIGN PATENT DOCUMENTS

WO 97/35299 9/1997 (WO) ..... G10H/1/00

OTHER PUBLICATIONS

Camurri et al, "Harp: A system for Intelligent Composer's Assistance", 8153 Computer, Jul. 24, 1991 No. 7 Los Alamitos, CA, pp. 64–67.

* cited by examiner

*Primary Examiner*—Marlon T. Fletcher
(74) *Attorney, Agent, or Firm*—Hayes, Soloway, Hennessey, Grossman & Hage, PC

(57) ABSTRACT

Method for fast (real-time) storage and retrieval of digital code sequences, each representing one or more predetermined features of a musical note, a fraction of a musical note, or group of musical notes and a system that implements this method, with the aim to automatically control electronic musical devices and thereby to avoid or alleviate certain problems associated with the prior art. Storage and retrieval will increase rapidity and efficiency even more by pre-selecting on the basis of related data or by using statistical information.

6 Claims, 4 Drawing Sheets

ABCDBCEBCF

METHOD FOR AUTOMATICALLY CONTROLLING ELECTRONIC MUSICAL DEVICES BY MEANS OF REAL-TIME CONSTRUCTION AND SEARCH OF A MULTI-LEVEL DATA STRUCTURE

FIELD OF THE INVENTION

The present invention generally relates to a computer-based method of constructing a multi-level data-structure called 'levelbase' from at least one sequence of digital codes, each code representing one or more predetermined features of a musical note, a fraction of a musical note, or group of musical notes, and searching the levelbase according to predetermined criteria while simultaneously (in real-time) generating digital codes to automatically control electronic musical instruments, and the invention also relates to a system that implements the above mentioned method.

BACKGROUND OF THE INVENTION

In history people have always been interested in methods and devices, be it mechanical, electronic or other, to automate the composing and/or playing of music. Especially since the so called MIDI-standard (Musical Instrument Digital Interface) was established in 1983 (MIDI 1.0 specification, Document No. MIDI-1.0, August 1983, International MIDI association), which defines a standard interface through which synthesizers, rhythm machines, computers, etc. can be linked together, substantial research has been devoted to the automated composing and/or playing of music.

Most of the resulting methods and devices were meant to automatically generate accompaniments to a solo instrument, to compose background music for films, plays and presentations or to produce music to entertain customers and to create the desired atmosphere in for instance restaurants or shops, commonly referred to as 'elevator music' or 'quiet music'.

One way of producing music automatically is to use an electronic system that produces so-called synthesized music. These systems generally comprise one or more electronic musical instruments or synthesizers and an automatic device producing control signals for them, which signals consist of digital code sequences in the case of this invention.

In the prior art methods and devices have been disclosed that use statistic approaches and employ for instance Markov processes, in which each musical note, fraction of a musical note or group of musical notes is treated as a single stochastic state in a sequence of states. Music is generated by probability functions stored in memory, starting from an initial musical code sequence (state) to which is added a successor code sequence having the highest probability according to the probability function. The Markov process is now in a new state and (part of) the increased sequence is used as a new initial code sequence so that the process endlessly generates control codes for one or more electronic musical devices that produce the resulting music accordingly. Additional rules are however necessary to produce typical musical structures and generate agreeable music. This method requires large amounts of training material to form the necessary conditional probability density functions in addition to the fact that synthesized music based on stochastic processes is usually quite monotonous.

Other prior art methods use heuristical rules based on musical expertise to produce such digital code sequences to control musical instruments. This technique is frequently employed in the field of artificial intelligence and is for instance disclosed in U.S. Pat. No. 4,926,737 issued to Minamitaka. The document U.S. Pat. No. 5,418,323 issued to Kohonen, discloses a method for controlling an electronic musical device that does not use heuristical rules, but forms a rulebase automatically on the basis of digital training sequences. The algorithm disclosed by Kohonen is based on finding a set of 'grammatical' rules in a sequence of codes representing musical information. Kohonen uses so-called DEC (Dynamically Expanding Context) grammars, which were originally developed for on-line speech recognition. Human speech consists however of sentences that form grammatically well formed pieces of information of limited length, while musical 'sentences' can be structures of undetermined length (e.g. long improvisations in Jazz). Because of this difference the rule base will haves to be updated very frequently during the training phase.

The construction of the rulebase from training material can either be static, i.e. based on the input and (batch) processing of existing (previously recorded) code sequences representing musical information, or dynamic, i.e. based on real-time input of codes by an electronic musical device, for instance an electronic musical instrument. The Kohonen algorithm is reasonably efficient in the case of input and batch processing of existing training sequences but, given the current performance of PC hardware and software, inefficient to use for real-time improvisation, because of the necessary frequent updates of the rule base.

The present invention avoids or alleviates certain problems and drawbacks associated with the prior art some of which are mentioned above.

SUMMARY OF THE INVENTION

The object of the present invention is to provide a method for fast (real-time) storage and retrieval of digital code sequences representing one or more predetermined features of a musical note, a fraction of a musical note, or group of musical notes, with the aim to automatically control electronic musical devices and thereby to avoid or alleviate certain problems associated with the prior art.

The above mentioned method of the invention comprises at least the following steps:

storing at least one digital training sequence consisting of one or more digital codes, each code representing one or more predetermined features of a musical note, a fraction of a musical note, or group of musical notes, in a multi-level datastructure called levelbase, consisting of information objects which are ranked in the levelbase on the basis of certain predetermined criteria, whereby every single object either contains a combination of one of the digital codes of said training sequence and so called related data, in the basic version of the invention being the next code in the sequence, or a combination of one of the digital codes of said training sequence and a reference to a sub-levelbase consisting of information objects related to the predecessing codes of the current digital code sequence, effectively forming a deeper level in the datastructure, whereby said storing of the digital training sequence can be conducted in a real-time manner, for instance during generation of the training sequence by an electronic musical device;

automatically generating a digital output sequence consisting of digital codes, each code representing one or more predetermined features of a musical note, a fraction of a musical note, or group of musical notes, including at least the steps of:

determining search and matching criteria according to which the levelbase is to be searched;

generating a digital output sequence by conducting sequential nearest-neighbour-matching of elements of an input sequence of digital codes each representing one or more predetermined features of a musical note, a fraction of a musical note, or group of musical notes and the objects in the levelbase, according to said predetermined search and matching criteria;

converting said automatically generated digital output sequence into digital control signals, suitable for controlling musical devices;

automatically controlling the musical devices with said digital control signals.

According to another realization the method according to the present invention is additionally characterized by the fact that separate features of a musical note, a fraction of a musical note, or group of musical notes, being for instance harmonic information or metrical information, are stored in separate levelbases, and the digital output sequence is generated by searching these levelbase simultaneously according to predetermined search criteria, enabling for instance superposition of different musical styles and arrangements of musical compositions.

Furthermore the method according to the invention can be characterized by the fact that prior to storage the training sequences are grouped on the basis of their related data, according to predetermined criteria, thus enabling the construction of a datastructure consisting of levelbases during the storage phase, which makes it possible to pre-select a levelbase on the basis of the desired characteristics of the related data, prior to the search phase, and thereby to reduce the number of search operations necessary to generate the desired digital output sequence.

In yet another embodiment the method of the present invention is characterized by the fact that during the storing of digital training sequences in a levelbase, two equal information objects, which have the same related data, are not expanded until a third object is to be added, which is equal to said other two equal objects, but does not have the same related data, in this way reducing the number of operations and the amount of memory necessary to update the levelbase when new training sequences are to be stored.

A method according to the present invention can further be characterized by the use of statistical information in addition to other criteria, to search the levelbase(s), for instance to select an output sequence which is most common from a set of suitable output sequences.

Unlike many methods known from the prior art, the system according to the present invention does not require large amounts of training material to produce agreeable music and its high efficiency enables functioning in real-time, given the current performance of PC hardware and software.

Also a system implementing the method according to the present invention is claimed, wherein control signals that are exchanged between different parts of the system comply with the international midi (Musical Instrument Digital Interface) standard.

BRIEF DESCRIPTION OF THE DRAWINGS

The invention will now be described in greater detail with reference to the attached drawings, in which FIG. 1(*a*) schematically shows a sample code sequence, where different characters represent different digital codes in the actual sequence.

DESCRIPTION OF THE INVENTION

Figures 1A, 1B:
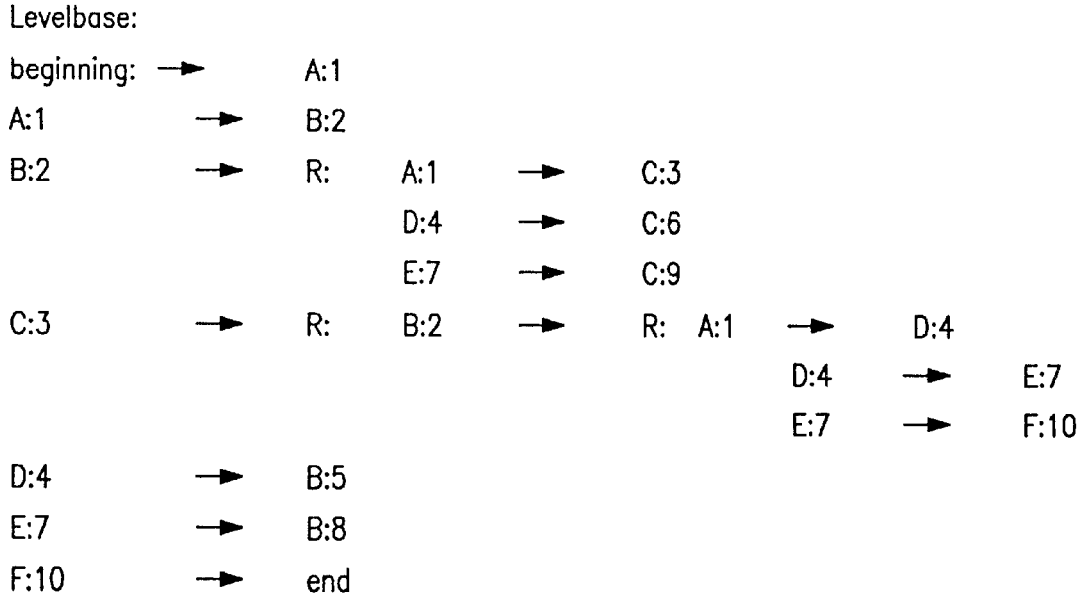
FIG. 1(*b*) schematically shows the levelbase structure resulting from the storing of the sample digital code sequence of FIG. 1(*a*), according to the method of the present invention, where it should be noted that the actual levelbase in this figure has been rotated 90° counterclockwise, so that the different levels of the levelbase are now vertical.

In the method of the invention code sequences represent one or more predetermined features of a musical note, a fraction of a musical note, or group of musical notes. These features are for instance the tone(s), the velocity of the note(s), and/or the duration of the note(s), but can represent other features also.

The method of the invention incorporates a training phase and a search and retrieval phase, followed by the actual generation of the desired digital code sequence suitable to control electronic musical devices. According to the method of the invention during the training phase at least one training sequence is to be stored in a multi-level datastructure called levelbase, which consists of information objects that are ranked on successively deeper levels according to certain predetermined criteria. These predetermined criteria are matching criteria to determine where subsequent elements of a training sequence have to be placed in a specific level of the levelbase structure. Below a brief description is given of some of the matching algorithms that are used in the method of the invention.

If we define two sequences E1 and E2 as follows: $\mathbf{E1}=\mathbf{E1}_1, \ldots, \mathbf{E1}_n$ and $$\mathbf{E2}=\mathbf{E2}_1, \ldots, \mathbf{E2}_n \tag{1}$$

where for instance $$\mathrm{E1}_i=\mathrm{Channel}\mathbf{1}_i\backslash\mathrm{Ticks}\mathbf{1}_i\backslash\mathrm{Note}\mathbf{1}_i\backslash\mathrm{Velocity}\mathbf{1}_i\backslash\mathrm{Length}\mathbf{1}_i \tag{2a}$$

$$\mathrm{E2i}=\mathrm{Channel}\mathbf{2}_i\backslash\mathrm{Ticks}\mathbf{2}_i\backslash\mathrm{Note}\mathbf{2}_i\backslash\mathrm{Velocity}\mathbf{2}_i\backslash\mathrm{Length}\mathbf{2}_i \tag{2b}$$

with $1 \leqq i \leqq n$, then two sequences E1 and E2 match if the following criteria are met:

Pitch matching:

$$\mathrm{Note}\mathbf{1}_i=\mathrm{Note}\mathbf{2}_i \text{ for all } i \tag{3}$$

which performs well in the case of melodies with a strong melodic structure and a simple time structure (Bach for instance), Relative pitch matching:

$$\mathrm{Note}\mathbf{1}_i=\mathrm{Note}\mathbf{2}_i+F \text{ for all } i \text{ and with } F\epsilon\mathbf{N} \tag{4}$$

n procent length matching:

$$(|\mathrm{Length}\mathbf{1}_i-\mathrm{Length}\mathbf{2}_i|/\max(\mathrm{Length}\mathbf{1}_i,\mathrm{Length}\mathbf{2}_i)*100<n \tag{5}$$

for all i according to which the lengths of the notes must be in a certain neigbourhood of each other, for instance n=70% is a good value, Elastic length matching:

$$E1_{i+1}=\text{Channel}1_{i+1}\backslash\text{Ticks}1_{i+1}\backslash\text{Note}1_{i+1}\backslash\text{Velocity}1_{i+1}\backslash\text{Length}1_{i+1} \quad (6)$$

$$E2_{i+1}=\text{Channel}2_{i+1}\backslash\text{Ticks}2_{i+1}\backslash\text{Note}2_{i+1}\backslash\text{Velocity}2_{i+1}\backslash\text{Length}2_{i+1} \quad (7)$$

and $$|\text{Length}1_i-\text{Length}2_i|>|\text{Length}1_{i+1}-\text{Length}2_{i+1}|*F \quad (8)$$

for all i and with F∈N which limits the amount of variation of relative length between consecutive notes in a melody. It is noted that the invention is not limited to the matching algorithms mentioned above, but can utilize every suitable matching technique.

During the training phase of the method of the invention at least one training sequence is stored in the levelbase structure mentioned above, by utilizing a matching algorithm like the algorithms mentioned previously. The construction of the levelbase from training material can either be static, i.e. based on the input and (batch) processing of existing (previously recorded) code sequences representing musical information, or dynamic, i.e. based on real-time input of codes by an electronic musical device, for instance an electronic musical instrument. Next the construction of the levelbase structure will be described.

The method of the invention uses a so-called levelbase to organize and store the code elements of digital training sequences in such a way that they can be found and retrieved very fast. It should however be noted that a levelbase structure is just a general way of describing a multi-level datastructure. The actual implementation can use for instance a balanced tree, hash table or other datastructure. A sequence can be empty or it consists of a first element (denoted as sequence.first) and another sequence (denoted as sequence.rest). The levelbase is a datastructure consisting of one or more layers containing information objects that consist of four variables: a root, a first element of the sequence, rest elements of the sequence and related data, some of which are pointer variables. The root is a pointer to a connected information object on the previous level, or NULL when there is no such connection, the first sequence element is for instance the first digital code of a training sequence, the rest elements variable corresponds to the rest of the sequence after the first element, and related data is data concerning the sequence, but will however in this description be regarded as pointing to the next element in the sequence, since the present invention is geared not to label sequences, but to find a consequence to a sequence. The number of information objects on the first level of the levelbase at a certain moment is equal to the number of different code elements of the training sequences that have been stored in the levelbase until that moment. Every information object can in its own right form the root of another levelbase consisting of information objects related to succeeding objects on deeper levels. FIG. 1(*a*) shows a sample code sequence ABCDBCEBCF, where different characters represent different digital code elements in a digital training sequence. FIG. 1(*b*) is a schematic representation of the resulting levelbase structure when the sample sequence of FIG. 1(*a*) is stored in a levelbase according to the method of the invention. When the sample sequence of FIG. 1(*a*) is used as a training sequence, the first four characters A, B, C and D are inserted in four information objects on the first level of the levelbase structure. The root of these objects is NULL, the related data of the object containing A points to B, the related data of the B-object points to C, the related data of C points to D, and the D-related data is the fifth element B of the training sequence i.c B. This is the second time that B occurs in the sequence and it is already known that B can be followed by a C. Now the root element of the information object containing B becomes the root of a new levelbase datastructure on a deeper level, thus forming a next/deeper level of the levelbase, and the reference to the related data is removed. In this newly formed sub-levelbase, both the predeceasing element (the first A) of the presently updated information object and its related data (the third C), as well as the predeceasing element D and its related data C are inserted.

On the insertion of the second C, the root element of the information object is again initialized with a sub-levelbase datastructure, thus forming a next/deeper level of the levelbase.

In this newly formed levelbase, both the predeceasing element B of the presently updated information object and its related data D, as well as the predecessing element B of the newly added element and its related data E are inserted. This time however, both the inserted elements are B, so in this next level again the root element of the only information object so far has to be initialized with a sub-levelbase structure to allow expansion to a deeper level. In this third level, both the predecessor of the first B, i.e. A, and its related data D, as well as the predecessor to the second B, i.e. D, and its related data E are inserted. This continues until the whole sequence is stored in the levelbase which has three levels in this example. The matching algorithms described earlier are used to compare every new sequence element with elements that are already in the present level of the levelbase to verify if and where in the levelbase a matching element exists. When the sequence is fully inserted, the levelbase structure contains four sub-levelbases and is three levels deep. In FIG. 1(*b*) the numbers refer to the position of the characters in the sample sequence of FIG. 1(*a*). The number and length of the training sequences that can be stored in the levelbase is only limited by time and storage space constraints.

Figure 2:
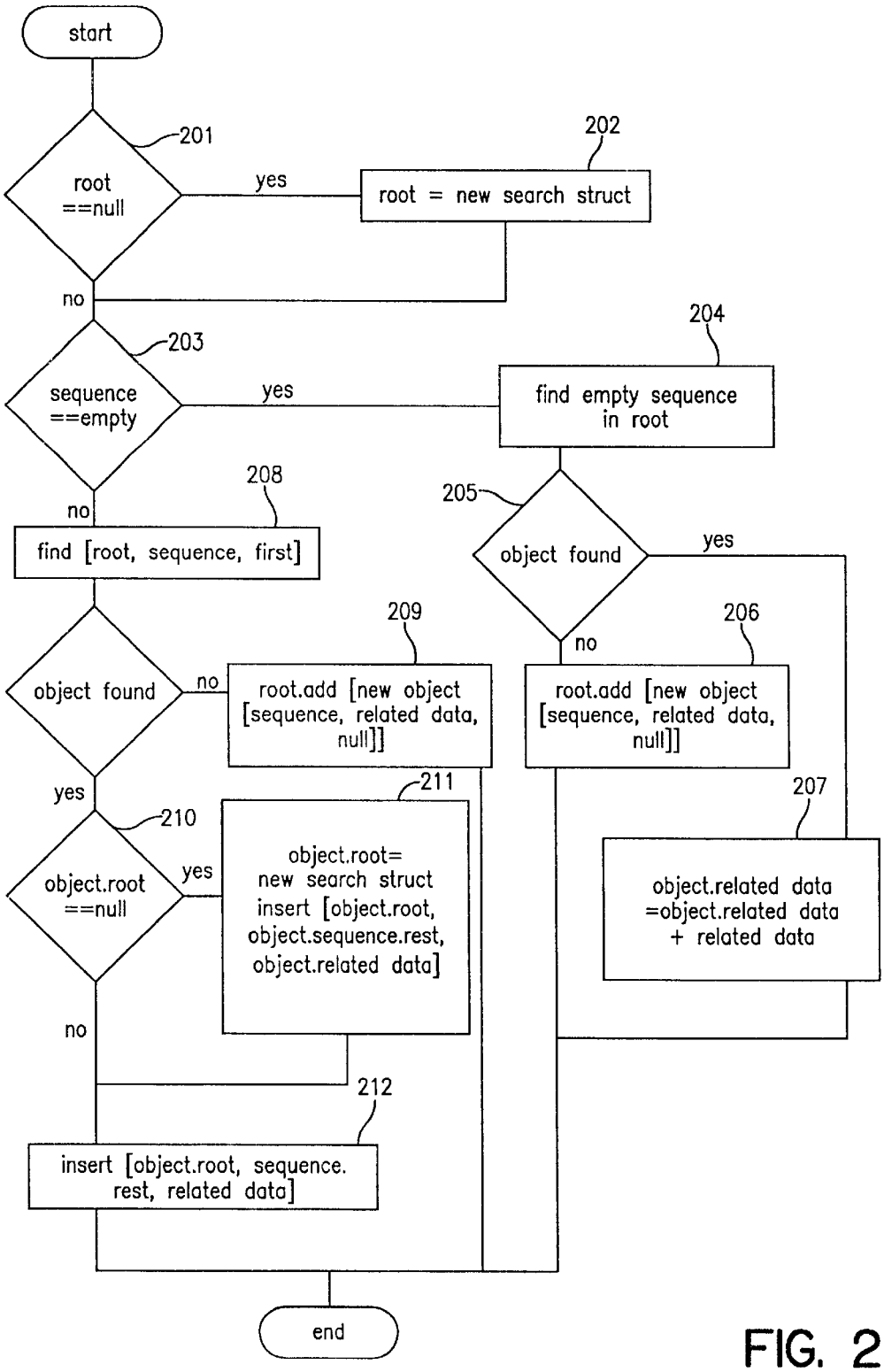
FIG. 2 shows a flow diagram of the storage of an element (code) of a digital code sequence in the levelbase structure, according to the method of the invention.

The flow chart of FIG. 2 is a schematic representation of the training phase of the method of the invention whereby a levelbase structure is constructed by recursively inserting related data with the next element of the sequence into a found or newly created information object at a next level of the levelbase. In FIG. 2 the descriptions are written in pseudo-language. New Searchstruct denotes the start of a new levelbase. The function add is used to insert a new information object at the same level, while insert is used to recursively insert related data with the next element of the sequence at a next level into a found or newly created object. Find is just a function performed on a levelbase structure to retrieve data matching a certain search key. As key both an empty sequence and the first element of a sequence are used. The insert function takes a root to a levelbase, a sequence and related data as parameters. For every element of a training sequence the flow chart is walked through from start to end. Hereafter the functions of the separate boxes in the chart of FIG. 2 will be explained.

Boxes 201 and 202: the parameter Root is actually a reference to the pointer of a root, that can be modified. So in case the parameter Root is NULL, a new sub-levelbase structure can be created and inserted into the variable which served as the pointer of the root.

Boxes 203 and 204: if the sequence is empty, an attempt is made to find an empty sequence in the root of the levelbase.

Boxes 205, 206 and 207: if no empty sequence is found, a new object is instantiated:

object.root=NULL;

object.sequence=sequence;

object.related data=related data;

This object is then added to the root of the levelbase structure and the function terminates. If an empty sequence is found, the inserted sequence must be similar to a previously inserted sequence. In normal cases this should not happen, but if one allows this (by inserting the same sequence twice) a list of related data could be set up in the related data variable of the object.

Box 208: if the sequence is not empty, an attempt is made to find a match for the first element of the sequence in the root of the levelbase.

Box 209: if the search for a match for the first element is unsuccessful, a new information object is added to the levelbase structure in a way similar to box 206 and the function terminates.

Box 210: if an object is found that matches the first element of the sequence, a test is done to find out if the root of this new found object is NULL or not i.e. if there is already a next sub-levelbase structure connected to the object and no related data, or not and in this latter case there is related data present.

Box 211: if the object's root is NULL, a new levelbase structure is created on the object's root and the object variables (root.object.root, object.sequence.rest, related data) are inserted in the root of the new sub-levelbase structure.

Box 212: the rest of the sequence and the related data are inserted in the new sub-levelbase structure and the whole process starts again at 201, albeit a level deeper.

After the training phase which delivers one or more levelbase structures that enable fast and efficient search and retrieval of data, follows the actual search and retrieval phase of the method according to the present invention. In this phase the method according to the invention also employs matching algorithms like the ones described above but is not limited to the algorithms described in this document. In addition to this the matching techniques used in the training phase and the search and retrieval phase respectively, can differ. The flow chart of FIG. 3 is a schematic representation of the search and retrieval phase.

The search is invoked with an input sequence that can be arbitrary. However when the input sequence is generated in real-time by for instance an electronic musical instrument, superposition of for instance different musical styles becomes possible. One could for instance use a rock-and-roll style input sequence and a levelbase structure trained with medieval style sequences. As regards the matching strategy there are all kinds of variations possible. If one is for instance not interested in best matches, but in good though varied continuations to an existing sequence, it is easy to provide for more variety in the search results by limiting the depth of the search.

Figure 3:
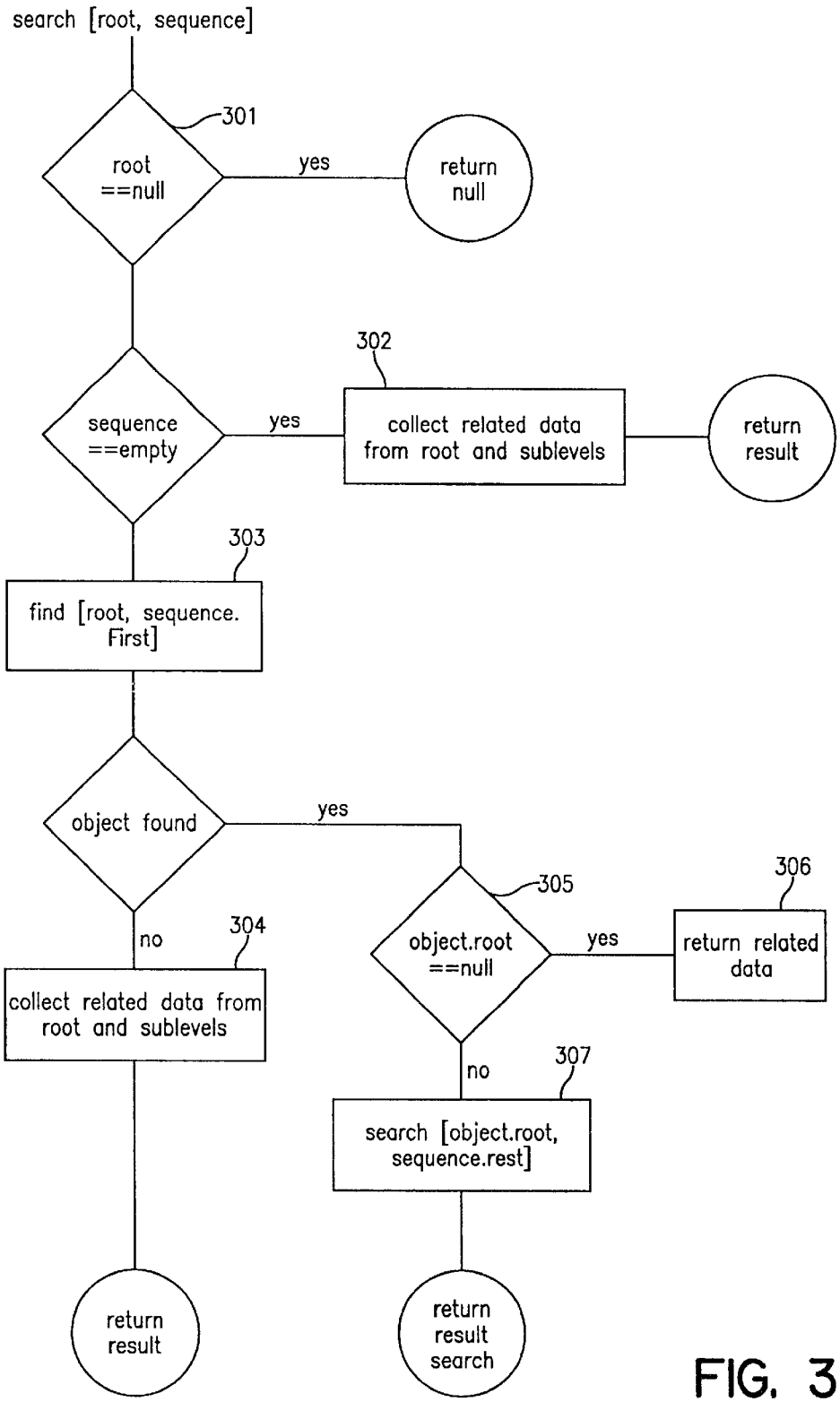
FIG. 3 shows a flow diagram of the process of searching the levelbase structure according to the method of the invention, to generate a control code sequence.

In FIG. 3 items that are equal to items in FIG. 2 are described by the same pseudo language references. Elements of the input sequence are tested one by one against the information objects in the desired levelbase, level by level. The result of a search is either empty (NULL) or consists of related data from an object or related data from a collection of levelbase objects. Hereafter the function of the separate boxes in FIG. 3 will be explained.

Box 301: if the Root parameter is NULL the search returns NULL.

Box 302: if the sequence parameter is empty i.e. when there are no (more) elements of the input sequence to be matched against the objects in the levelbase structure, all objects on the present level and all sublevels are considered to be good solutions to the query and the related data from the object on the present level and all sublevels are collected into a list which is returned as a result.

Box 303: if the sequence is not empty, one tries to find a match for the first element of the sequence in the current level of the levelbase. The function Find only searches the objects of the current level, so not the sub-levelbases that may be available. If successful Find returns the object which matches the first element of the sequence.

Box 304: if no match is found, all related data is collected and returned as a result, like in the explanation of Box 302. When this happens it means that there is no exact match and that there are more possible sequences in the levelbase that match the sequence queried.

Box 305: if a matching object was found during the step described by Box 303, the object is tested to find out whether the Root parameter (which may be pointing to a next level of the levelbase) of that object is NULL or not.

Box 306: if the Root parameter is NULL, the function returns the related data from the root.

Box 307: if the Root parameter of the object is not NULL, a recursive call is made into the root with the next element of the current sequence and the whole process starts all over albeit a level deeper.

Off course, all kinds of optimizations for the search phase could be implemented, e.g. one could use an internal iterator to select one solution from a set of suitable solutions, according to some predetermined criteria, or select one solution randomly.

According to another realisation of the method of the present invention, separate features of a musical note, a fraction of a musical note, or a group of musical notes, being for instance harmonic information or information regarding metrical style, are stored in separate levelbases, and the digital output sequence is generated by searching these levelbases simultaneously, which makes for instance superposition of musical features, or the arranging of musical pieces possible.

Furthermore, if through some external circumstances not all returned results (related data matching the query sequence) are suitable, it is possible to select the suitable related data afterwards (or even while searching). However this has as a drawback that it could happen that a search-result contains no more elements after selection, although a more shallow search would have yielded suitable results. One obvious solution is to search less and less deep until suitable elements are found. This is however expensive as regards computational effort. A more efficient solution which is the subject of claim 3, is to set up a tree of levelbases, each containing a root and sequences that are suitably related according to certain criteria. This makes it possible to preselect a levelbase on the basis of related data prior to the search phase and reduces thereby the number of search operations necessary to generate the desired suitable output sequence.

In another embodiment of the invention, two equal levelbase objects which have the same related data, are not expanded but stored in the object as a list of objects containing the related data and the sequence.rest data. The sequence.rest data is necessary because if, at a later stage another object is added which is equal but does not have the same related data, all three sequences have to be expanded. In this way the number of operations and the amount of memory necessary to update the levelbase when new training sequences are to be added, can be reduced.

If the datastructure in which information objects are stored on multiple levels, is suitable, it is possible to add statistical information. In that case it is possible to make a selection based on the statistical information provided, when more suitable solutions are found. One could select the resulting sequence that is most common, least common or even choose one element randomly. In the last case one avoids the (substantial) computational overhead of collecting all objects into a list. This last case is interesting if one is interested in only one matching solution.

Figure 4:
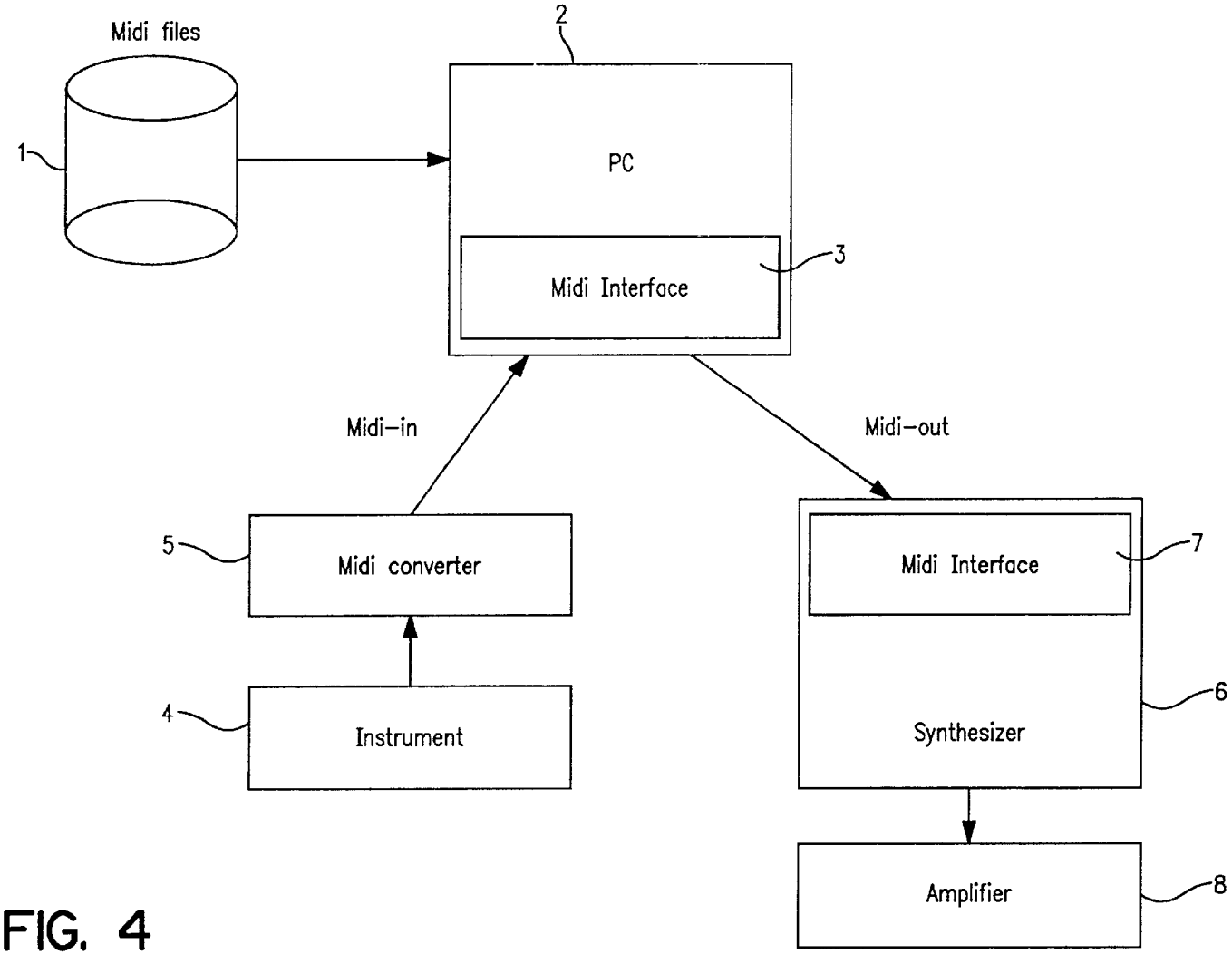
FIG. 4 shows a block diagram of a system implementing the method of the invention.

The method of the invention is particularly intended for the production of sequences of digital codes suitable for controlling electronic musical instruments. The produced control code sequences can be converted into control signals complying with the MIDI (Musical Instrument Digital Interface) standard (MIDI 1.0 specification, Document No. MIDI-1.0, August 1983, International MIDI association), but is not limited to this standard. FIG. 4 illustrates one example of a system in which the method of the invention is implemented according to claim 6. The digital code sequences and control signals in this system comply with the MIDI-standard.

The method and system according to the invention described above, have many applications, especially where real-time live music improvisation is desired, for instance for on stage musical performances. It is also an efficient composition tool for professional composers and can serve as an add-on to existing MIDI devices for non-professional musicians.

It can also be shown mathematically that when the same digital code sequence of n symbols is analyzed, and both a levelbase according to the invention and a DEC grammar according to Kohonen (see introduction) is constructed, the levelbase performs much better than the DEC-technique. When the levelbase according to the invention has the structure of a balanced tree, the mathematical complexity of the DEC-technique is proportional to $\frac{1}{2}n(n+1)$ whereas the complexity of the levelbase-balanced tree technique according to the invention is only n log n. So in many ways the invention avoids or alleviates problems associated with the prior art.

What is claimed is:

1. A method for fast storage and retrieval of digital code sequences representing one or more predetermined features of a musical note, a fraction of a musical note, or group of musical notes, to automatically control electronic musical devices, comprising the steps of:

storing at least one digital training sequence consisting of one or more digital codes, each code representing one or more predetermined features of a musical note, a fraction of a musical note, or group of musical notes, in a multi-level datastructure called levelbase, consisting of information objects which are ranked in the levelbase on the basis of certain predetermined criteria, whereby every single object either contains a combination of one of the digital codes of said training sequence and related data, or a combination of one of the digital codes of said training sequence in combination with a reference to a sub-levelbase consisting of information objects related to the predecessing codes of the current digital code sequence, effectively forming a deeper level in the datastructure, whereby said storing of the digital training sequence can be conducted in a real-time manner; and automatically generating a digital output sequence consisting of digital codes, each code representing one or more predetermined features of a musical note, a fraction of a musical note, or group of musical notes, including at least the steps of:

determining search and matching criteria according to which the levelbase is to be constructed and searched;

generating a digital output sequence by conducting sequential nearest-neighbour-matching of elements of an input sequence of digital codes each representing one or more predetermined features of a musical note, a fraction of a musical note, or group of musical notes and the objects in the levelbase, according to said predetermined search and matching criteria;

converting said automatically generated digital output sequence into digital control signals, suitable for controlling musical devices; and automatically controlling the musical devices with said digital control signals.

2. A method according to claim 1, wherein separate features of a musical note, a fraction of a musical note, or group of musical notes, are stored in separate levelbases, and the digital output sequence is generated by searching these levelbases simultaneously according to predetermined search criteria, enabling for instance superposition of different musical styles and arrangements of musical compositions.

3. A method according to claim 1, wherein prior to storage, the training sequences are grouped on the basis of their related data, according to predetermined criteria, thus enabling the construction of a data-structure consisting of sub-levelbases during the storage phase, which makes it possible to pre-select a levelbase on the basis of the desired characteristics of the related data prior to the search phase and thereby reduces the number of search operations necessary to generate the desired digital output sequence.

4. A method according to claim 1, wherein during the storing of digital training sequences in a levelbase, two equal information objects, which have the same related data, are not expanded until a third object is to be added which is equal to said other two equal objects, but does not have the same related data, in this way reducing the number of operations and the amount of memory necessary to update the levelbase when new training sequences are to be stored.

5. A method according to claim 1, wherein in addition to other criteria, statistical information is used to search the levelbases, for instance to select an output sequence which is most common from a set of suitable output sequences.

6. A system for automatically controlling musical instruments that are equipped with a digital interface adhering to the international MIDI (Musical Instrument Digital Interface) standard, consisting of:

a digital storage medium containing digital training sequences consisting of one or more digital codes, each code representing one or more predetermined features of a musical note, a fraction of a musical note, or group of musical notes, adhering to the MIDI-standard whereby these digital training sequences are stored in a multi-level datastructure called levelbase, consisting of information objects which are ranked in the levelbase on the basis of certain predetermined criteria, whereby every single object either contains a combination of one of the digital codes of said training sequence and related data, or a combination of one of the digital codes of said training sequence in combination with a reference to a sub-levelbase consisting of information objects related to the predecessing codes of the current digital code sequence, effectively forming a deeper level in the datastructure, whereby said storing of the digital training sequence can be conducted in a real-time manner, a personal computer (PC), connected to said digital storage medium that is equipped with a MIDI interface card and with suitable software to automatically generate a digital output sequence consisting of digital codes, each code representing one or more predetermined features of a musical note, a fraction of a musical note, or group of musical notes, by:

(a) determining search and matching criteria according to which the levelbase is to be constructed and searched;

(b) generating a digital output sequence by conducting sequential nearest-neighbour-matching of elements of an input sequence of digital codes each representing one or more predetermined features of a musical note, a fraction of a musical note, or group of musical notes and the objects in the levelbase, according to said predetermined search and matching criteria;

(c) converting said automatically generated digital output sequence into digital control signals, suitable for controlling musical devices; and (d) automatically controlling the musical devices with said digital control signals;

an electronic instrument that delivers its output signal to an MIDI-converter that converts this output signal into a digital signal that adheres to the international MIDI-standard whereby the MIDI-converter delivers the MIDI-in signal to the personal computer to which it is connected, and a synthesizer that receives the MIDI-out signal, and is equipped with a MIDI-interface and delivers its output signal to an amplifier.

* * * * *